US009751657B2

(12) United States Patent
Cote et al.

(10) Patent No.: US 9,751,657 B2
(45) Date of Patent: Sep. 5, 2017

(54) MATERIAL HANDLING PALLET

(71) Applicant: PALAC INDUSTRIES INC., St-Felix-De-Kingsey (CA)

(72) Inventors: Christian Cote, St-Cyrille-De-Wendover (CA); Andre Tanguay, St-Felix-De-Kingsey (CA)

(73) Assignee: PALAC INDUSTRIES INC., St-Felix-de-Kingsey, QC (CA)

( * ) Notice: Subject to any disclaimer, the term of this patent is extended or adjusted under 35 U.S.C. 154(b) by 0 days.

(21) Appl. No.: 15/030,444

(22) PCT Filed: Nov. 12, 2014

(86) PCT No.: PCT/CA2014/000824

§ 371 (c)(1),
(2) Date: Apr. 19, 2016

(87) PCT Pub. No.: WO2015/070333

PCT Pub. Date: May 21, 2015

(65) Prior Publication Data

US 2016/0272366 A1 Sep. 22, 2016

Related U.S. Application Data

(60) Provisional application No. 61/903,601, filed on Nov. 13, 2013.

(51) Int. Cl.
*B65D 19/38* (2006.01)
*B65D 19/00* (2006.01)

(52) U.S. Cl.
CPC ..... *B65D 19/0095* (2013.01); *B65D 19/385* (2013.01); *B65D 2519/00024* (2013.01);
(Continued)

(58) Field of Classification Search
CPC ..... B65D 19/0095; B65D 19/385; B65D 2519/00024; B65D 2519/00059
(Continued)

(56) References Cited

U.S. PATENT DOCUMENTS 1,334,409 A * 3/1920 Sindelar ..... B65D 19/0028 105/375
1,359,835 A * 11/1920 Pease ..... B65D 19/0051 105/375

(Continued)

FOREIGN PATENT DOCUMENTS

CN 2510408 9/2002
CN 2719736 8/2005

(Continued)

OTHER PUBLICATIONS

EP Search Report issued May 29, 2017 in corresponding EP application No. 14862246.

*Primary Examiner* — Daniel J Troy
*Assistant Examiner* — Timothy M Ayres
(74) *Attorney, Agent, or Firm* — Norton Rose Fulbright Canada LLP

(57) ABSTRACT

A metal pallet (10) has a deck (12), a base (14) and a plurality of beams (16) therebetween. The deck (12), the base (14) and the beams (16) may be formed from light-weight sheet metal. The metal sheets are folded into the desired shape to respectively form the beams (16), and panels (18, 22) and slats (20, 32) for the deck (12) and the base (14). The panels (18, 22) and the slats (20, 32) are corrugated and the opposed side edges thereof may be folded upon themselves to provide for robust multi-ply edge constructions. Different types of corrugations may be provided over the panels (18, 22) and the slats (20, 32) to locally reinforce the pallet (10). The bottom portion of the beams (16) may be plastically deformed to create arched opening
(Continued)

(58) to permit side entry of pallet handling equipment. The plastically deformed regions (60) of the beams (16) may be configured to improve the mechanical properties of the beam while providing maximal clearance for pallet handling equipment.

13 Claims, 12 Drawing Sheets

(52) U.S. Cl.
CPC ..... *B65D 2519/00059* (2013.01); *B65D 2519/00094* (2013.01); *B65D 2519/0094* (2013.01); *B65D 2519/00273* (2013.01); *B65D 2519/00308* (2013.01); *B65D 2519/00333* (2013.01); *B65D 2519/00373* (2013.01); *B65D 2519/00562* (2013.01); *B65D 2519/00835* (2013.01)

(58) Field of Classification Search
USPC ..... 108/53.3, 57.29, 57.3
See application file for complete search history.

(56) References Cited

U.S. PATENT DOCUMENTS 1,508,898 A * 9/1924 Smith ..... B65D 19/004 105/375
1,612,382 A * 12/1926 Lehman ..... B65D 19/0028 108/57.29
2,455,197 A * 11/1948 Sullivan ..... B65D 19/0038 108/52.1
2,524,599 A * 10/1950 Philp ..... B65D 19/0073 108/57.34
3,172,374 A * 3/1965 Allen ..... B65D 19/0051 108/52.1
3,839,970 A * 10/1974 Keeler ..... B65D 19/0038 108/53.3
3,861,326 A * 1/1975 Brown ..... B65D 19/0012 108/57.1
D335,743 S * 5/1993 Nordstrom ..... D34/38
5,367,960 A 11/1994 Schleicher
5,440,998 A * 8/1995 Morgan, IV ..... B65D 19/0048 108/57.18
5,460,103 A 10/1995 Dunn
8,448,582 B2 5/2013 Jian
2005/0178299 A1 8/2005 Rasmussen et al.
2009/0205540 A1 * 8/2009 Nielsen ..... B65D 19/0093 108/57.12

FOREIGN PATENT DOCUMENTS

GB 609769 10/1947
JP S482838 1/1973
JP 3014402 8/1995
JP 08164936 6/1996

* cited by examiner

MATERIAL HANDLING PALLET

TECHNICAL FIELD

The application relates generally to material handling and, more particularly, to metal pallets, such as aluminum and galvanized steel pallets.

BACKGROUND OF THE ART

While most pallets are made of wood, some pallets are also made of plastic and metal. Each material has advantages and disadvantages relative to the others.

Presently, metal pallets represent less than 1% of the market. Metal pallets are generally costly compared to wooden pallets. Some metallic pallets are subject to oxidation, the use thereof for outside storage may thus be problematic. Also metal and plastic pallets typically offer less adherence for the stack of goods to be carried than wooden pallets, which may result in stability problems. Finally, conventional metal pallets are generally heavy.

Accordingly, there is a need for a new metallic pallet design.

SUMMARY

In accordance with a general aspect of the present invention, there is provided a metal pallet comprising a deck mounted on a plurality of laterally spaced-apart beams, at least peripheral ones of said beams having a one-piece sheet metal body including a pair of legs extending upwardly from a bottom end, the legs defining therebetween a hollow internal volume, the one-piece sheet metal having at least one die formed portion protruding into said hollow internal volume between longitudinally opposed ends of the one-piece sheet metal body, each of said at least one die formed portion defining an arched opening across the one-piece sheet metal body.

In accordance with another general aspect, there is provided a metal pallet comprising a deck, a base and a plurality of beams therebetween, each beam having a one-piece sheet metal body folded into a V-shaped elongated member including a pair of legs extending upwardly from a flat bottom end, the legs defining therebetween an internal volume, the flat bottom end having at at least one location therealong a plastically deformed portion die pressed into the internal volume between the legs of the one-piece sheet metal body so as to define a corresponding transversal arched opening between opposed longitudinal ends of the beam, the plastically deformed portion being fully accommodated within the internal volume.

In accordance with a further general aspect of the invention, there is provided a galvanized steel pallet has a deck, a base and a plurality of beams therebetween. The deck, the base and the beams are formed from lightweight galvanized steel sheet. The galvanized steel sheets are folded into the desired shape to respectively form the beams, and panels and slats for the deck and the base. The panels and the slats are corrugated and the opposed side edges thereof may be folded upon themselves to provide for robust multi-ply edge constructions. Different types of corrugations may be provided over the panels and the slats to locally reinforce the pallet.

Further details of these and other aspects of the present invention will be apparent from the detailed description and figures included below.

DESCRIPTION OF THE DRAWINGS

Reference is now made to the accompanying figures, in which.

DETAILED DESCRIPTION OF THE PREFERRED EMBODIMENTS

Figure 1:
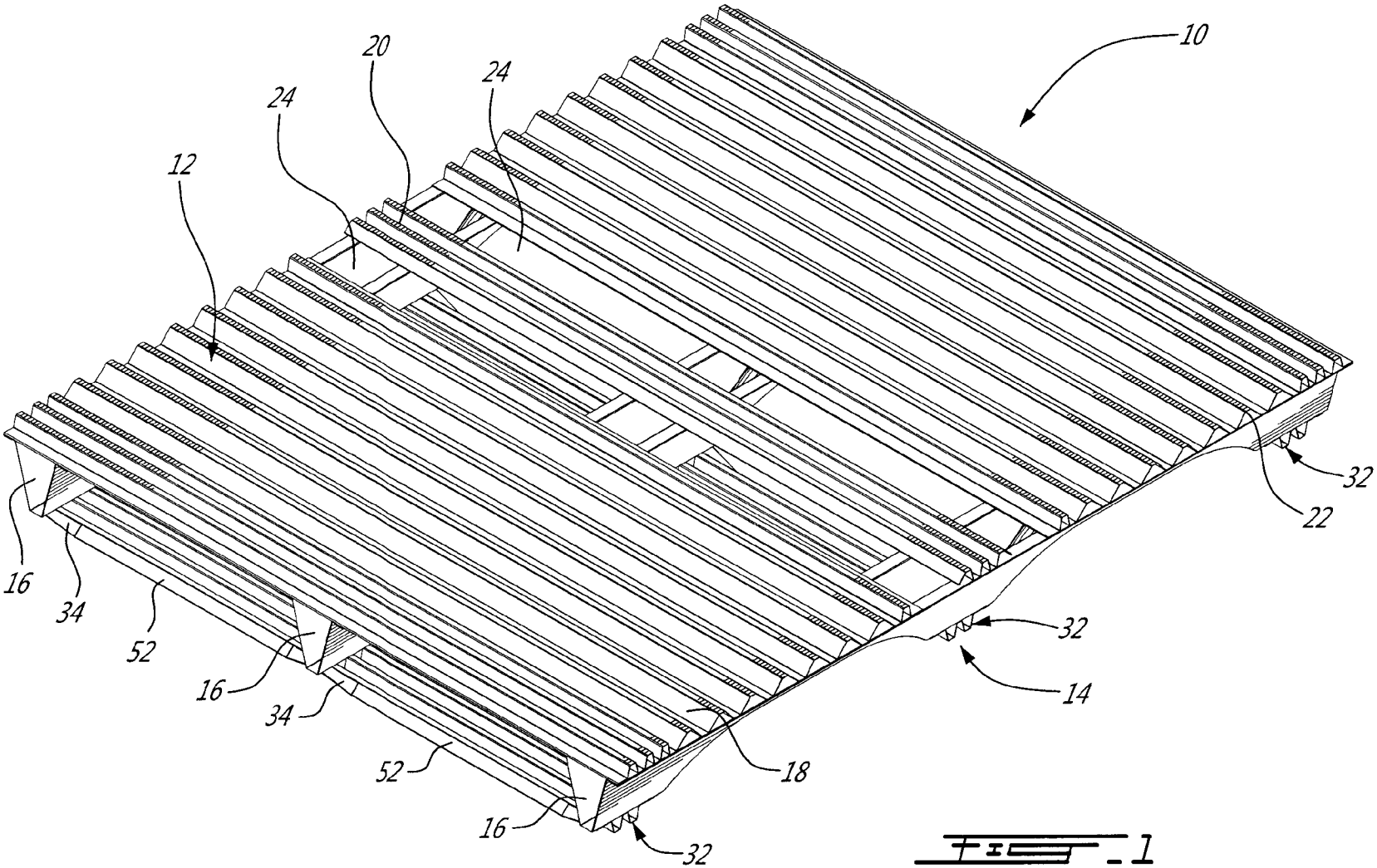
FIG. 1 is a perspective top view of a galvanized steel palette in accordance with an embodiment of the present invention.
Figure 2:
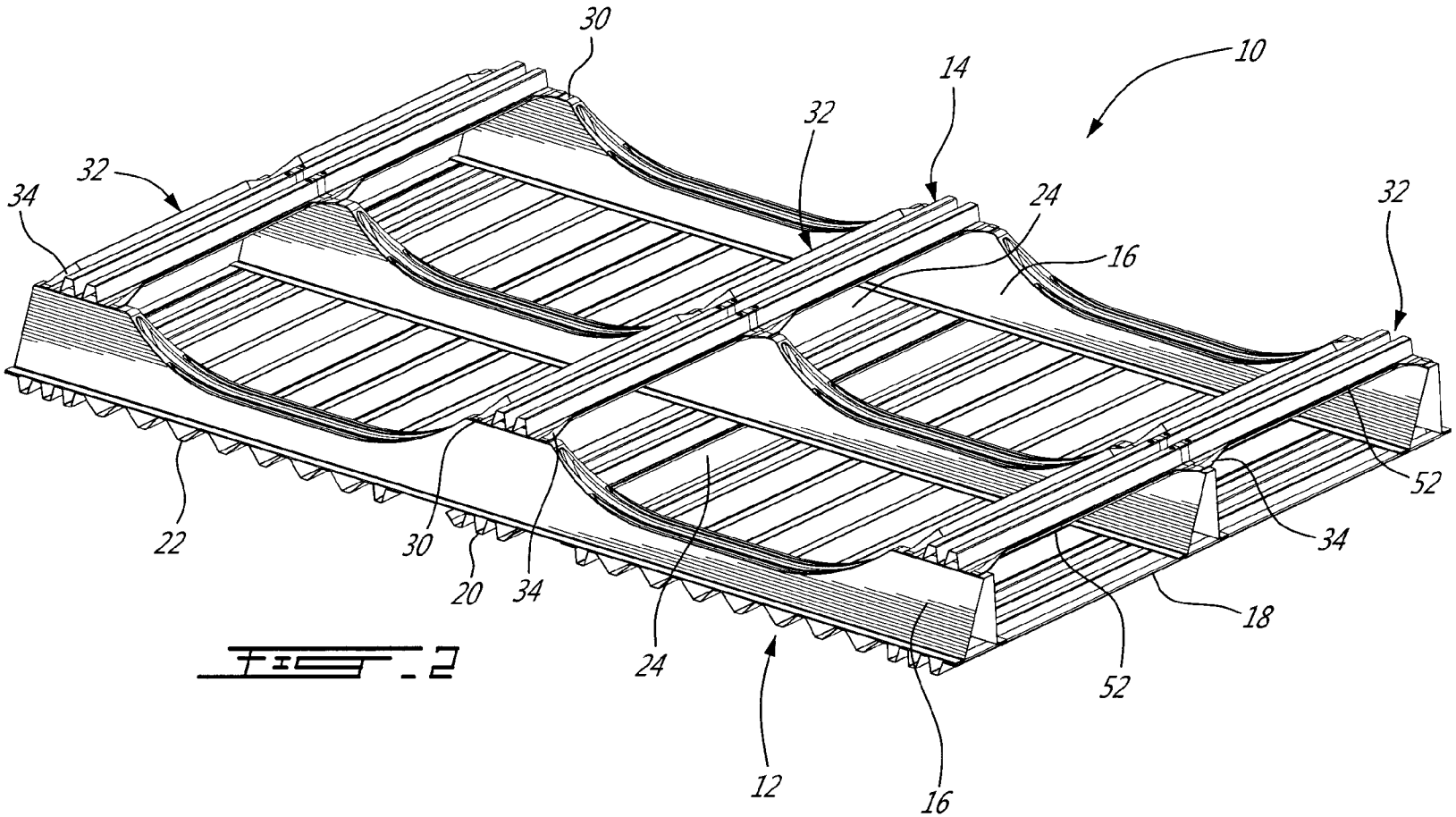
FIG. 2 is a perspective bottom view of the palette shown in FIG. 1.

FIG. 1 illustrates an example of a 48"×40"×5" (1000 m×1200 mm×102 mm) weldless galvanized steel pallet 10. The pallet 10 generally comprises a load supporting deck 12, a base 14 and a set of beams 16 (three in the illustrated embodiment) interconnecting the deck 12 to the base 14. The deck 12, the base 14 and the beams 16 may all be made from galvanized steel sheets. According to one example, the components of the deck 12, the base 14 and the beams 16 are made from a lightweight gauge of galvanized steel, such as lightweight gauges typically used in the ventilation industry. For instance, the components of the pallets could be made from standard 24 gauge galvanized steel sheets (ASTM 653B G90). It is understood that different gauges of steel could be used. For instance, any combination of 10 gauge galvanized steel sheet to 24 gauge galvanized steel to 24 gauge could be used.

Figure 3:
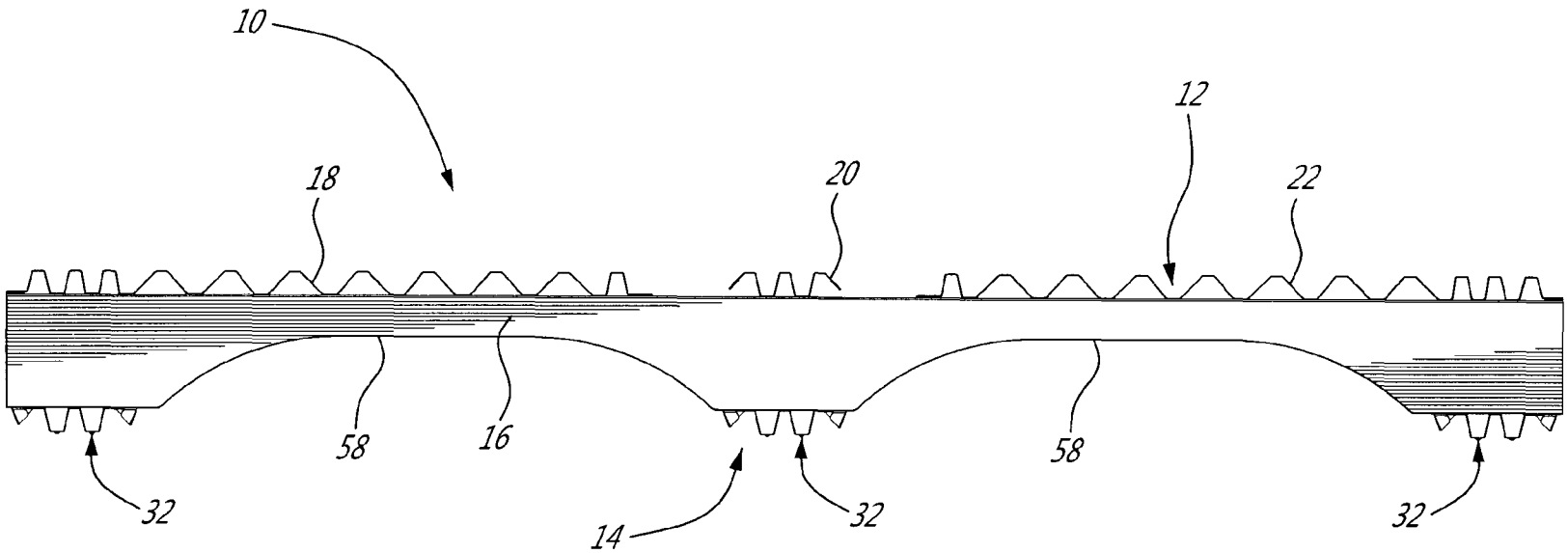
FIG. 3 is a side view of the palette shown in FIG. 1.
Figure 4:
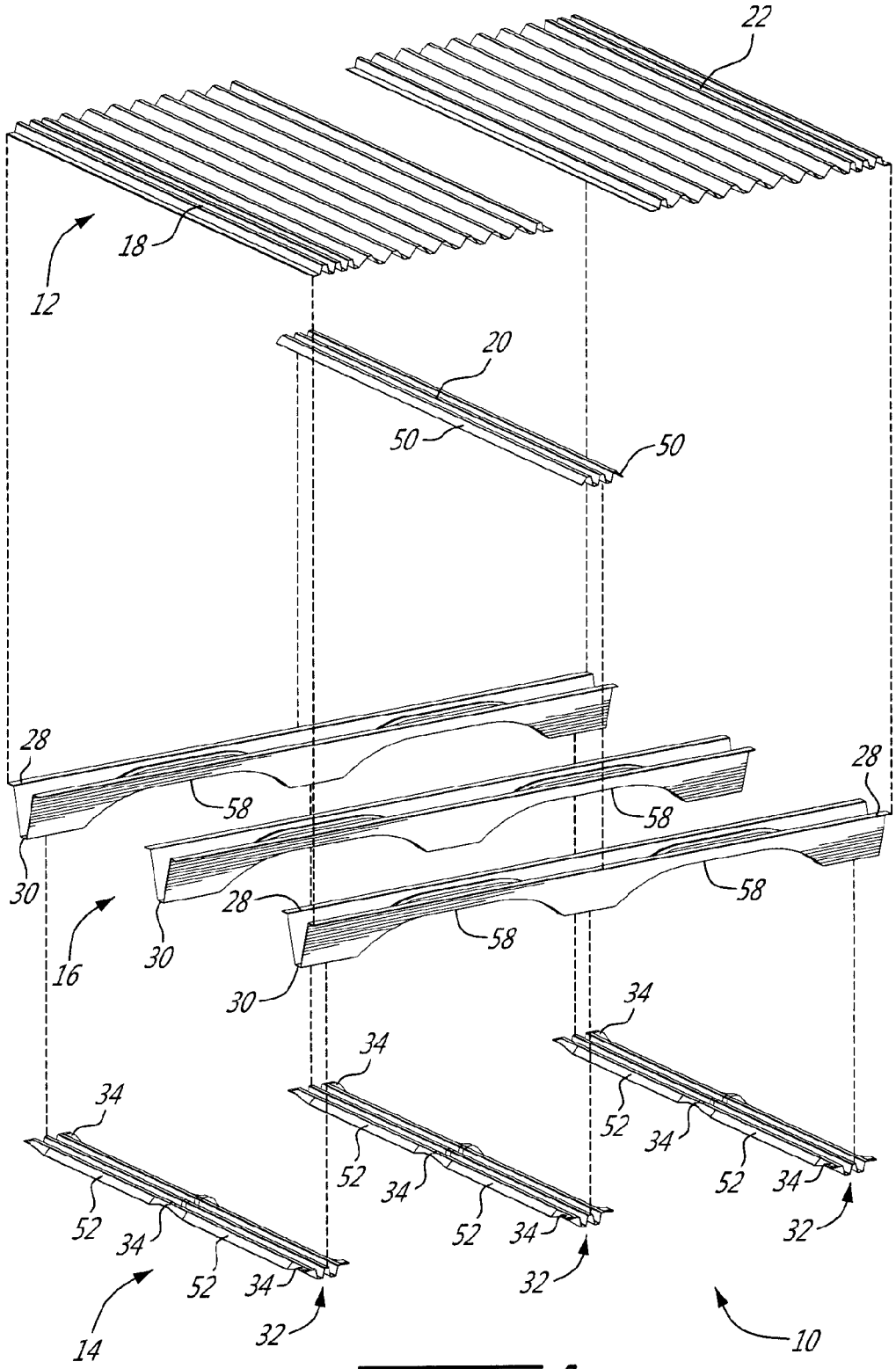
FIG. 4 is an exploded view of the palette illustrating the panels, the beams and the slats forming the palette.

Referring concurrently to FIGS. 1 to 4, it can be appreciated that the deck 12 of the pallet 10 may be composed of a front corrugated panel 18, a central corrugated slat 20 and a rear corrugated panel 22. It is understood that the number of panels and slats may vary. Referring more particularly to FIG. 3, it can be appreciated that slat 20 is narrower than the panels 18, 22. For instance, the panels 18, 22 may have a width (W) equal to 500 mm whereas the slat 20 may have a width (w) of 100 mm. The slat 20 may be spaced-apart from the front and rear panels 18, 22 so as to define front and rear gaps 24 therewith. The central slat 20 and the panels 18, 22 are coterminous in the transversal direction of the pallet 10. The corrugations of the panels 18, 22 and slat 18 extend transversally to the longitudinal axis of the pallet 10.

In the embodiment illustrated in FIGS. 1-4, the panels 18, 22 and the central slat 20 are mounted on top of three laterally spaced-apart longitudinal beams 16. In the illustrated embodiment, the beams 16 are identical. However, they could be different. According to the illustrated embodiment, all the beams 16 have a V-shaped open-top section with longitudinally extending lateral flanges 28 at the top. The deck panels 18, 22 and the central slat 20 may be riveted or otherwise suitably attached to the lateral flanges 28 of the beams 16. The beams 16 may extend longitudinally the full extent of the pallet 10. The bottom end of the beams 16 is flat to provide a suitable mounting surface 30 for the base 14.

According to the illustrated example, the base 14 is composed of three corrugated bottom slats 32. The bottom slats 32 are uniformly distributed along the length of the beams 16 and oriented transversally with respect thereto. The bottom slats 32 comprise a front bottom slat, a central bottom slat and a rear bottom slat. The front, central and rear bottom slats 32 may be identical and are coterminous to the deck panels 18, 22 and the deck central slats 20 in the transversal direction of the pallet 10. According to the illustrated example, each bottom slat 32 has three pairs of laterally extending mounting flanges 34 distributed along the length thereof. The mounting flanges 34 of the bottom slats 32 may be riveted or otherwise suitably attached to the flat bottom end 30 of each beam 16.

Figure 5:
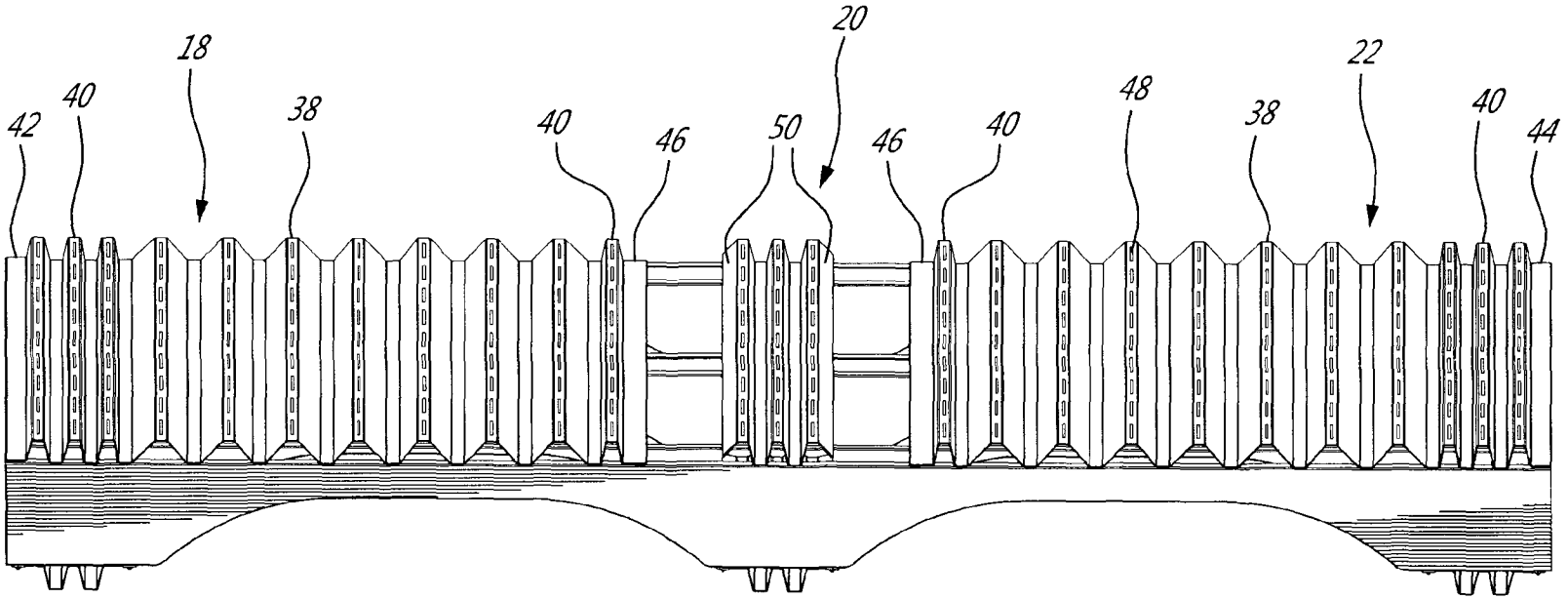
FIG. 5 is an enlarged side view of the palette illustrating details of the corrugation pattern of the top panels of the palette.

As best shown in FIG. 5, the front and rear panels 18, 22 of the deck 12 each have two different types of corrugations: central corrugations 38 and edge corrugations 40. The central and the edge corrugations 38, 40 may have a trapezoidal shape and a same depth (e.g. 19 mm). However, the pitch of the corrugations 38 in the central area is greater than the pitch of the corrugations 40 in the lateral edge areas of the panels 18, 22. For instance, the pitch of the central corrugations 38 may be twice that of the edge corrugations 40. In accordance with one example, the pitch of the central corrugations 38 is 54 mm and the pitch of the edge corrugations 40 is 27 mm. The central corrugations 38 are designed to maximize the top bearing surface area of the pallet 10 while offering an adequate load bearing surface capability relative to the weight of the panel. According to one example, the central corrugations 38 have an 88 degrees opening angle. In contrast, the edge corrugations 40 may have a 26 degrees opening angle. The edge corrugations 40 have a smaller pitch and have almost vertical sides or legs extending between top and bottom webs, thereby providing for better mechanical properties with greater vertical load bearing capabilities at the lateral edges of the panels 18, 22.

Multi-ply edges portions may be provided at the opposed lateral sides of the panels. For instance, a 3-ply edge portion 42 may be formed along the front edge of the front panel 18 by folding the front edge portion of the panel 18 twice upon itself. A 3-ply edge portion 44 may be similarly formed along the rear edge of the rear panel 22. The folding of the edge portions of the panels 18, 22 at the front and the back of the pallet 10 eliminates the presence of sharp edges that would otherwise be present at the periphery of the pallet 10 and that could potentially be harmful for an operator when manually handling the pallet 10. Furthermore, the multi-ply edge structures at the front and rear of the pallet 10 also act as front and rear bumpers to better resist potential lateral impacts of the forks of a forklift truck or other pallet handling equipment at the front and rear fork entries of the pallet 10.

A 2-ply edge portion 46 may also be formed along the rear edge of the front panel 18 and along the front edge of the rear panel 22 adjacent to the central slat 20. The 2-ply edge portions are formed by folding the edge portion of each panel upon itself. This also provides for smoother rounded edge at the top surface of the pallet 10.

A non-slip or anti-skid treatment surface may be applied on the top facing surface of the deck panels 18, 22 and of the central slat 20 (i.e. the deck surface in contact with the merchandise to be carried on the pallet). The anti-skid treatment may take the form of small convex embossments or protrusions on the top web surface of the corrugations as for instance shown at 48 in FIG. 5. Arrays of spaced-apart elongated embossments 48 may be formed along the top web of selected corrugations. According to one example, the embossments have a 1 mm height and a 5 mm length. According to one embodiment, more than 550 embossments are distributed over the deck of the pallet 10 to provide a better adherence and, thus, a better stability of the merchandise on the pallet 10.

Like the top panels 18, 22, the top slat 20 is corrugated. The corrugations of the slat 20 may also have a generally trapezoidal shape. According to one embodiment, the pitch of the corrugations of the slat 20 is equal to 27 mm. The slat 20 may have opposed longitudinal downwardly sloping edge portions 50. The sloping edge portions 50 may define a 45 degrees slope. The sloping edge portions 50 may be folded upon themselves to provide a 2-ply edge structure as described above with respect to the panels 18, 22.

The corrugations of the bottom slats 32 forming the base 14 of the pallet 10 may be generally similar to the corrugations of the top slat 20 and the side corrugations 40 of the panels 18, 22 (similar depth and pitch). As can be appreciated from FIG. 4, downwardly sloping wing-like projections 52 extend between the mounting flanges 34 along the opposed longitudinal sides of each slat 32. The wing-like projections 52 extend downwardly at an appropriate angle (e.g. 45 degrees) to form raceways to facilitate the entry of pallet handling equipment (e.g. forks of a forklift truck) in the end entries of the pallet. The wing-like projections 52 may have a 2-ply configuration by folding over a portion of the lateral edge portions of the slats 32 upon themselves. This provides for a more robust raceway construction for absorbing impact forces. The mounting flanges 34 also contribute to render the wing-like projections 52 more robust.

As mentioned hereinbefore, each beam 16 has a V-shaped open-top section.

Figure 6:
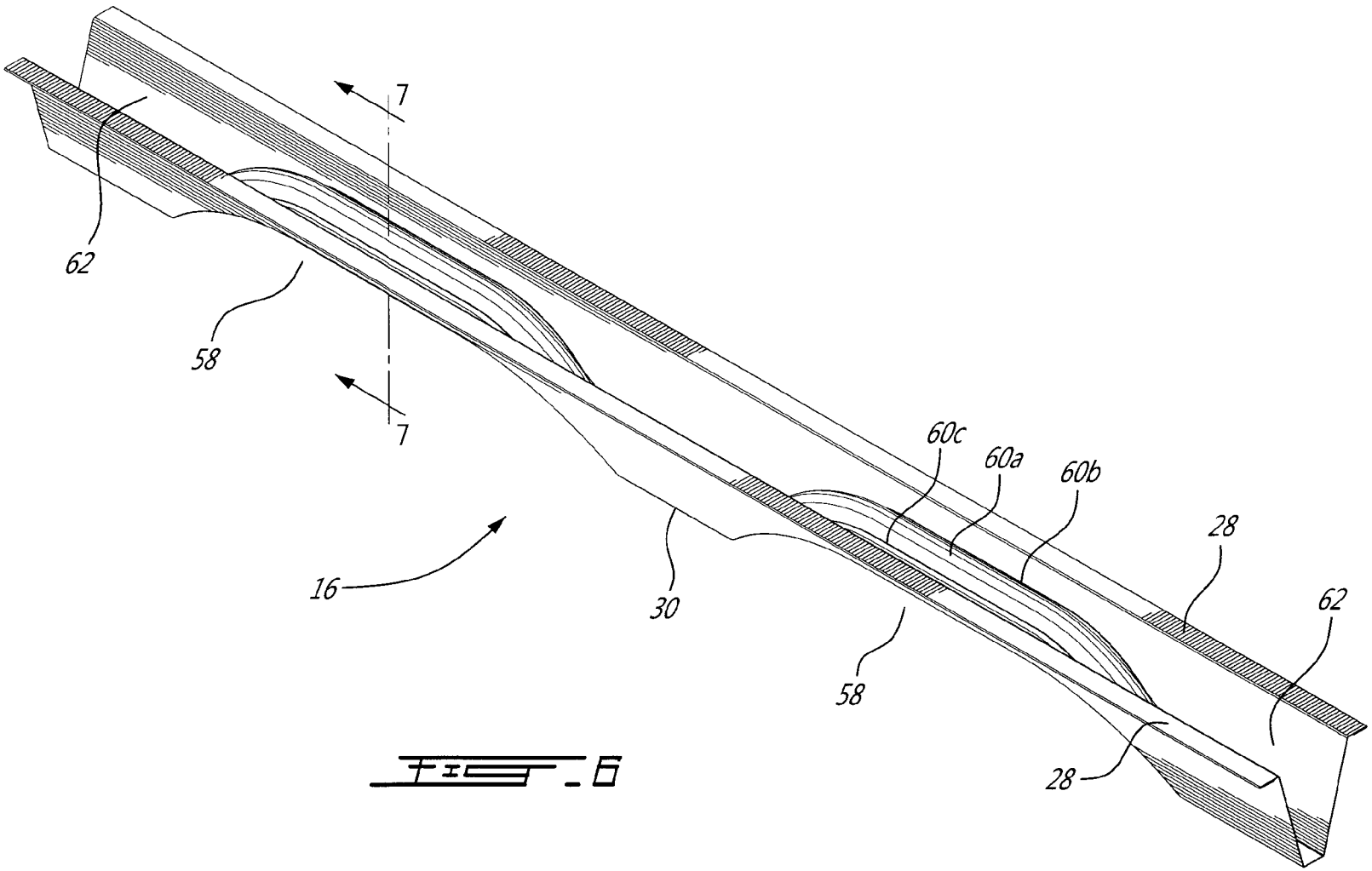
FIG. 6 is a bottom perspective view of a V-shaped beam forming part of the pallet.

The V shape of the beams provides added resistance to buckling under high-stacking loads. The V-shaped beams provide a rigid and sturdy bridge between the top and bottom sections of the pallet 10. According to an embodiment, an angle of about 30 degrees is defined between the sidewalls of each beam 16. Still according to this embodiment, the height of each beam is equal to 90 mm. The top lateral flanges 28 used to attach the beams 16 to the top panels 18, 22 and the top central slate 20 may have a 2-ply configuration. As described above with respect to the panels 18, 22 and the slates 20, 32, the 2-ply configuration may be obtained by folding over the side edge portions of the sheets of galvanized steel used to form the beams 16. As shown in FIGS. 1, 3 and 6, a pair of elongated arched openings 58 may be defined in the sides of each beam 16 for providing side entries for pallet handling equipment. The pallet shown in FIG. 1 with the side entries and the end entries is a four-way entry pallet that can be lifted from any sides thereof. As can be appreciated from FIGS. 6 and 7, the openings 58 may be provided by pressing or deep drawing a portion of the material of the flat bottom end 30 of the beams between the diverging sides or legs of the beams.

Figure 7:
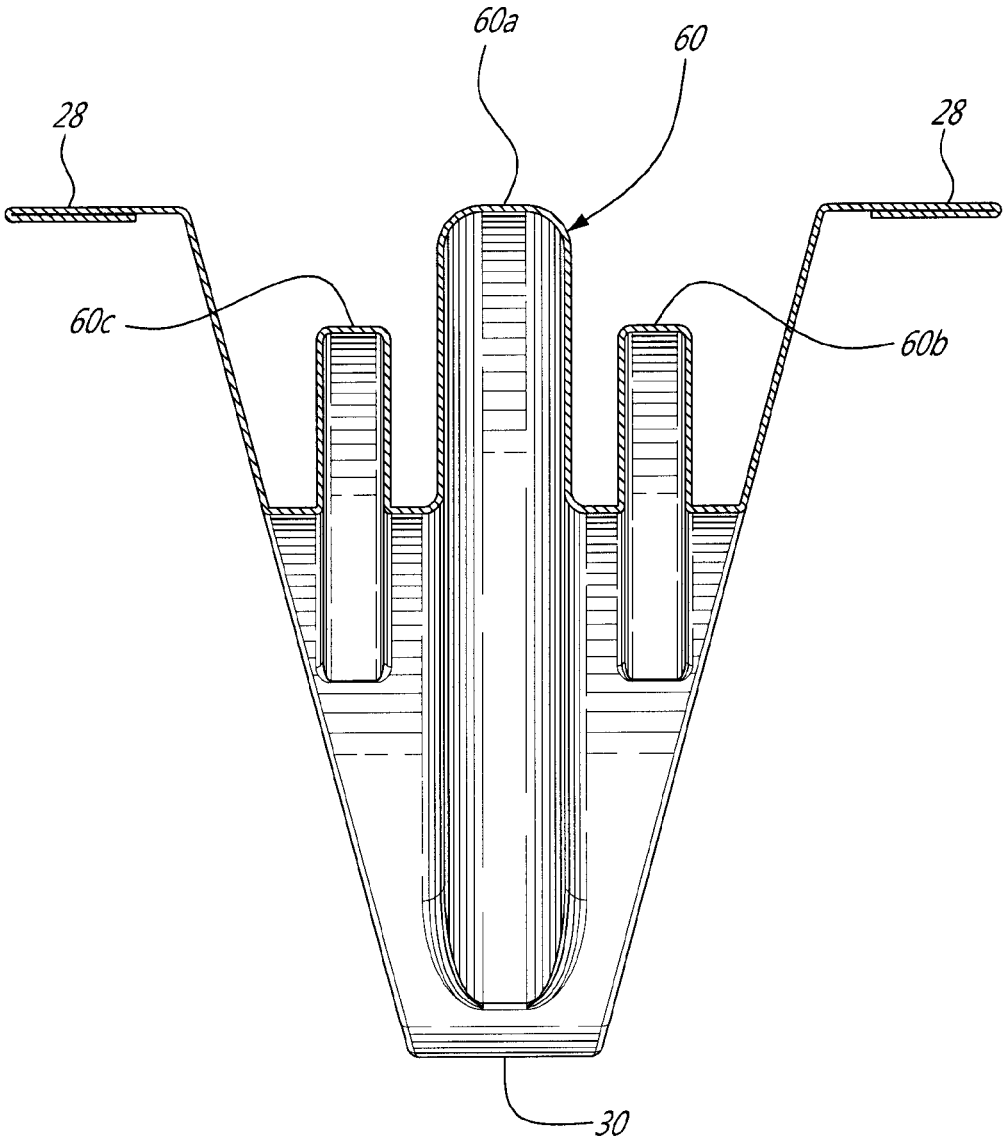
FIG. 7 is a cross-section view of the V-shaped beam taken along line 7-7 in FIG. 6.

The material pressed into the V-shaped section of the beams (i.e. the die formed portions) can be seen at 60 in FIG. 7. The die formed portions may include a central arch 60*a* and a pair of secondary arches 60*b*, 60*c* on opposed sides of the central arch 60*a*. These die formed portions also contribute to strengthen the beams 16.

Figure 9A:
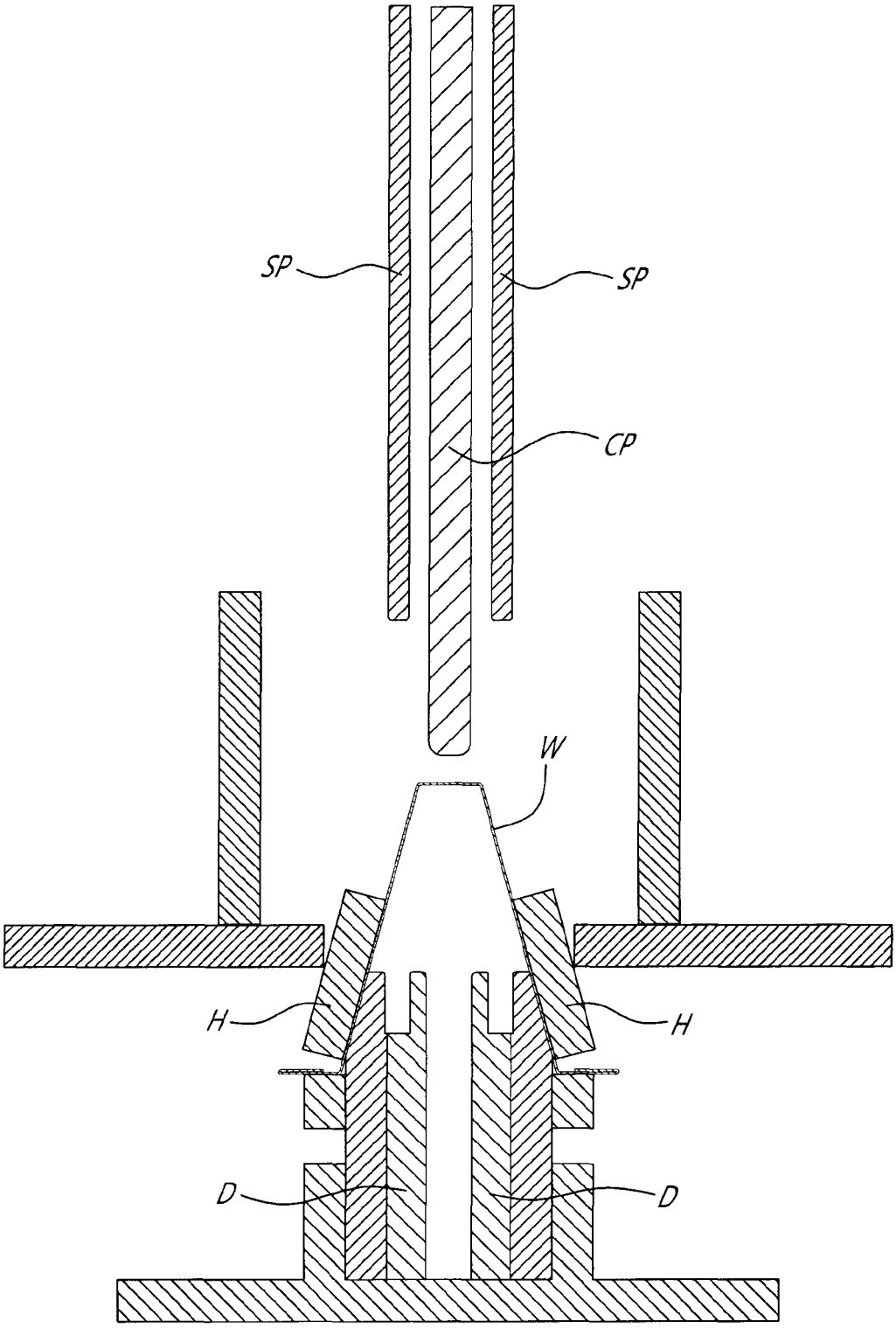
FIGS. 9*a*-9*d* are sequential views schematically illustrating the sheet metal forming process used to form transversal arched openings in the beams.
Figure 9B:
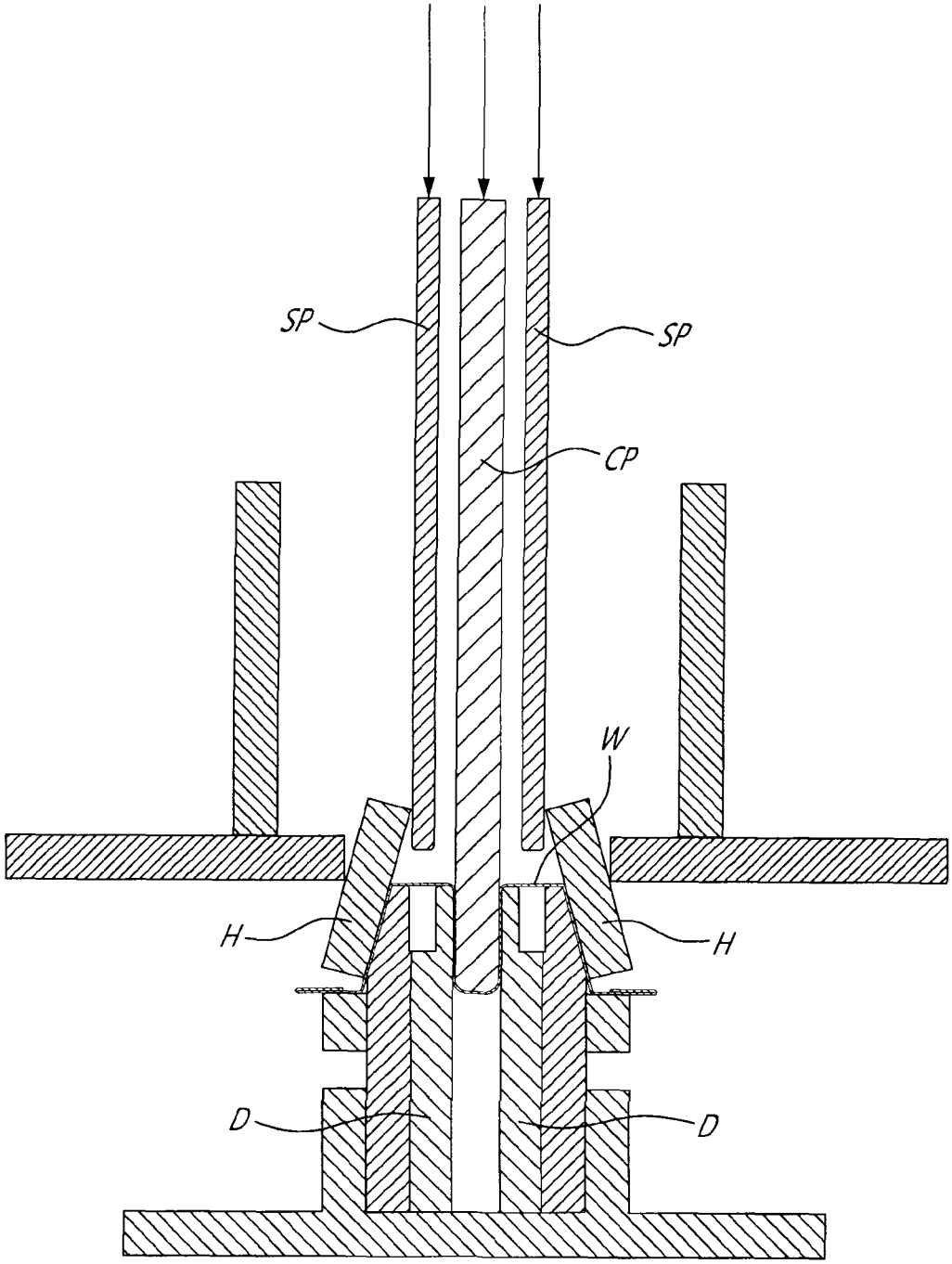
Figure 9C:
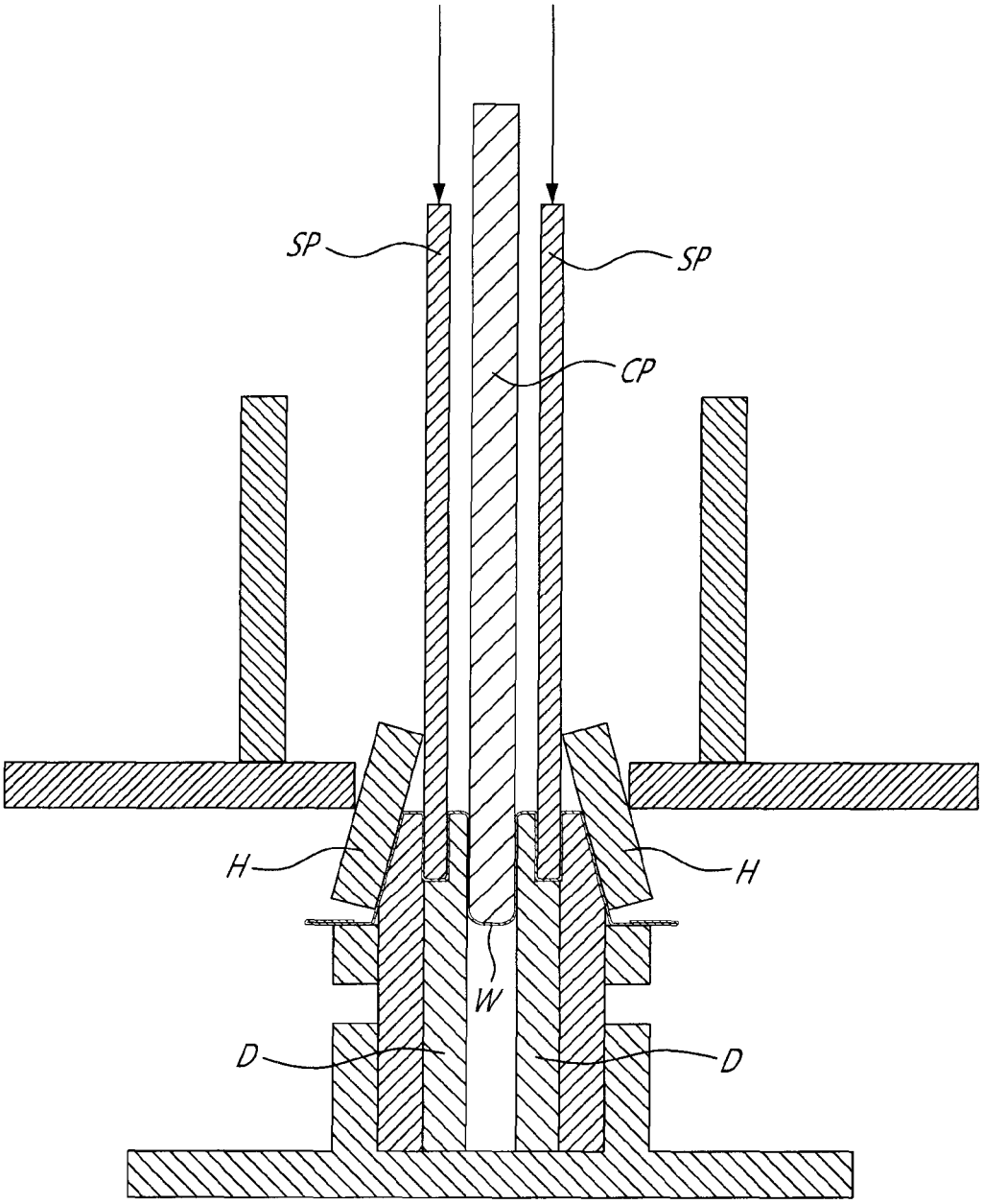
Figure 9D:
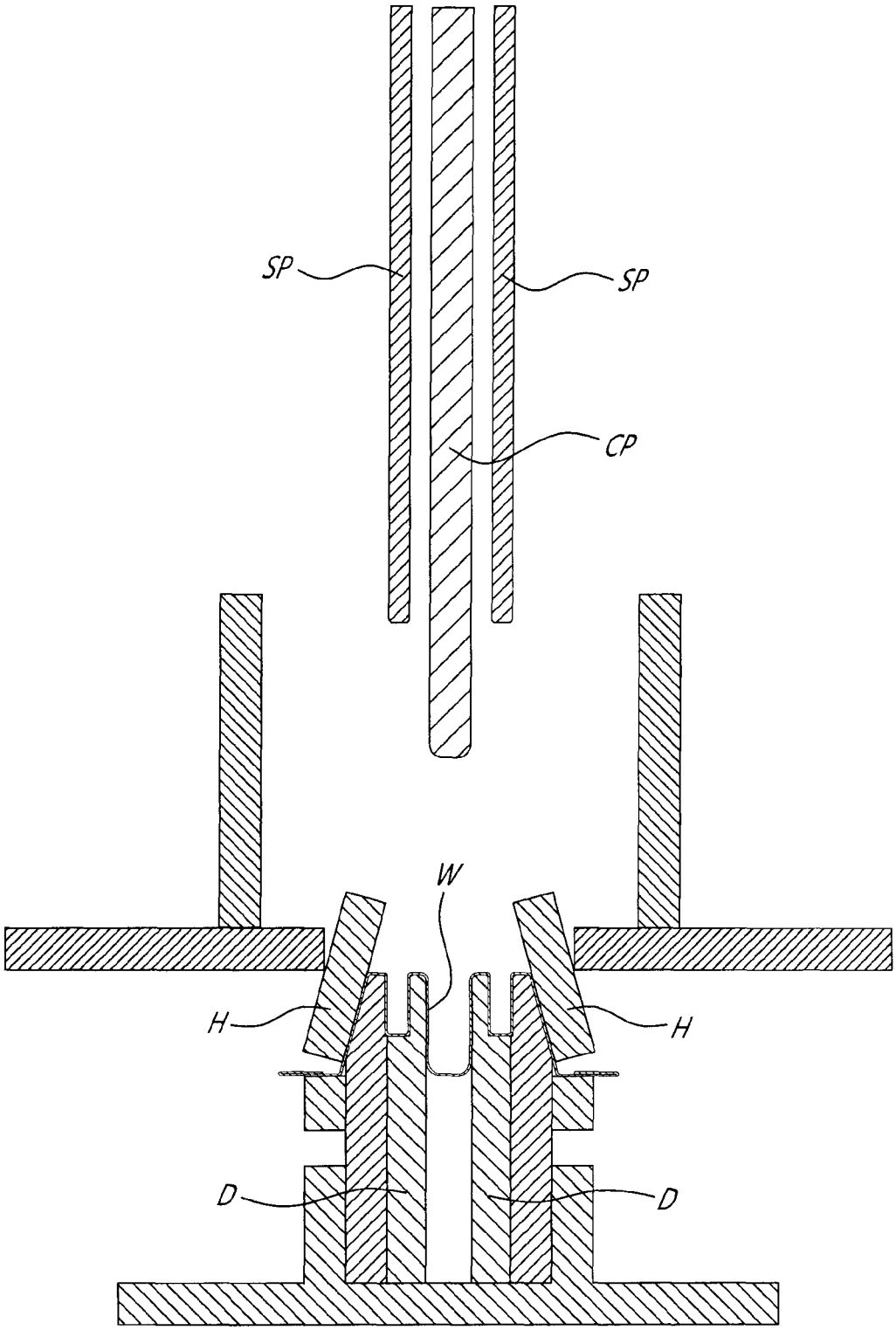

A shape transformation process that can be used to form the transversal arched openings 58 in the beams 16 is shown in FIGS. 9*a* to 9*d*. First, a sheet metal workpiece W is folded into a V-shaped elongated beam member. Then, as shown in FIG. 9*a*, the pre-folded sheet metal workpiece W is seated face down on a die D and held thereon by a blank-holder H. Thereafter, as shown in FIG. 9*b*, a central punch CP is lowered to press the underlying portion of the flat bottom end of the inverted-V-shaped workpiece W into a corresponding central cavity defined in the die D, thereby providing for the formation of the central arched 60*a*. As can be appreciated from FIG. 7, the central arch 60*a* is fully accommodated within the internal volume defined between the legs of the cold formed V-shaped beam 16. In the illustrated example, the height of the central arch 60*a* corresponds to the height of the legs (i.e. the top surface of the central arch is leveled with the mounting flange 28). It is understood that the central arch 60*a* must not project out of the top open end of the beam in order not to interfere with the mounting of the deck to the flanges 28. In order to further increase the height of the arched openings 58, a pair of secondary punches SP disposed on opposed sides of the central punch CP are pushed into the workpiece material to draw the material adjacent to the previously formed central arch 60*a* into corresponding cavities defined in the die D. This result in the formation of secondary arches 60*b*, 60*c* on opposed sides of the central arch 60*a*. As can be appreciated from FIG. 7, the height of the secondary arches 60*b*, 60*c* is less than that of the primary arch 60*a*. The central arch 60*a* and the secondary arches 60*b*, 60*c* cooperate to further strengthen the beam. Finally, as shown in FIG. 9*d*, the central punch CP and the secondary punches SP are withdrawn from the workpiece W to permit subsequent removal of the so cold formed arched beam from the die D.

The above shape transformation process with material retention provides for the formation of strong beams with lateral entry features for the pallet. It is understood that other suitable stamping or press forming processes could be used to form the arched openings with material retention of the plastically deformed zones within the internal volume between the legs of the beam.

The remaining land of material between the adjacent arched openings 58 and at the outer ends thereof provide the required mounting surfaces for the transversal slats 32 of the base 14.

As shown in FIG. 6, the edge portions 62 at the opposed longitudinal ends of the legs of each beam may be folded inwardly at right angles to provide additional protection to the beams 16 against collisions.

Figure 8:
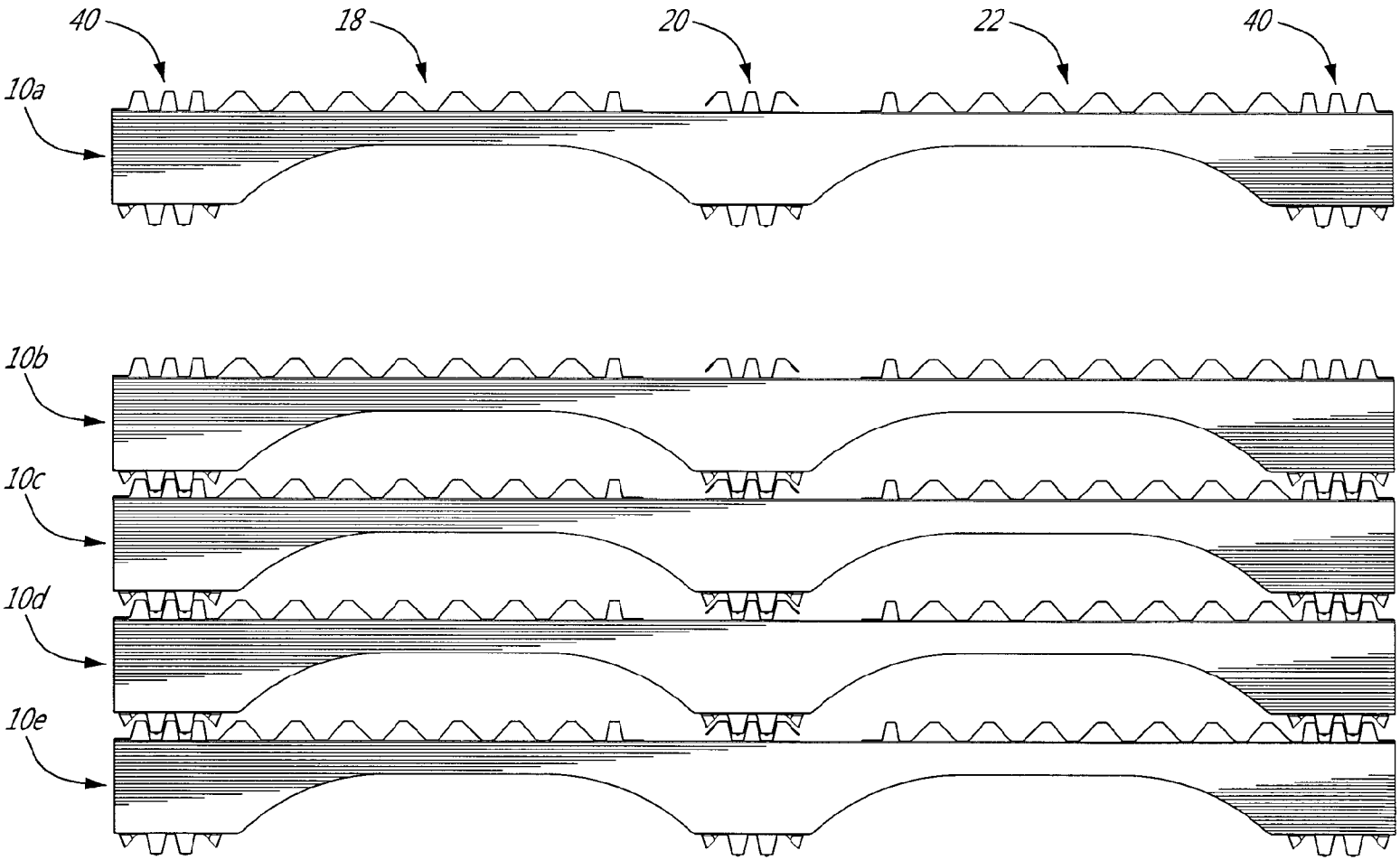
FIG. 8 is a side elevation view of a stack of pallets, the pallets being nested one into each other.

As shown in FIG. 8, similar pallets 10*a*, 10*b*, 10*c* 10*d*, 10*e* . . . may be stacked one upon another with the downwardly projecting ridges of the corrugations formed in the bottom slats 32 fitting in corresponding troughs of the side corrugations 40 of the deck panels 18, 22 and of the central top slat 20. This nesting engagement between the corrugations of the pallets provides for added stacking stability. It also provides for a more compact stacking arrangement than conventional wooden pallets.

Advantages of the above described metal pallet constructions comprise: load bearing capability, durability, recyclable, sanitary, easy to clean, light weight and robust, fire resistant, thermally stable and re-usable.

The above description is meant to be exemplary only, and one skilled in the art will recognize that changes may be made to the embodiments described without departing from the scope of the invention disclosed. For instance, any suitable metal material, such aluminum could be used to form the pallet. Also, depending on the size of the pallets, a different number of arched openings could be formed in the beams 16 to permit side entries of material handling equipment. Also, only the peripheral beams (the one along the sides of the pallet) could be provided with the side openings. It is also contemplated to manufacture a pallet without the corrugated bottom slat. Other modifications which fall within the scope of the present invention will be apparent to those skilled in the art, in light of a review of this disclosure, and such modifications are intended to fall within the appended claims.

What is claimed is:

1. A metal pallet comprising a deck mounted on a plurality of laterally spaced-apart beams, at least peripheral ones of said beams having a one-piece sheet metal body including a pair of legs extending upwardly from a bottom end, the legs defining therebetween a hollow internal volume, the one-piece sheet metal body having at least one die formed portion protruding into said hollow internal volume between longitudinally opposed ends of the one-piece sheet metal body, each of said at least one die formed portion defining an arched opening across the one-piece sheet metal body, wherein the deck has at least one corrugated metal panel having two different types of corrugations, wherein the at least one corrugated metal panel has a first type of corrugations along a side area thereof and a second type of corrugations in a central area thereof, the second type of corrugations having a greater pitch than the first type of corrugations.

2. The metal pallet defined in claim 1, wherein the die formed portion has main and secondary portions, the main portion projecting further into the internal volume than the secondary portion.

3. The metal pallet defined in claim 2, wherein the main portion includes a central arch, the secondary portion including first and second lateral arches respectively disposed on opposed sides of the central arch.

4. The metal pallet defined in claim 3, wherein the central arch extends upwardly to a height which is equal to or less than a height of the legs, the first and second lateral arches having a height which is less than the legs.

5. The metal pallet defined in claim 1, wherein the one-piece sheet metal body has a V-shaped cross-section, and wherein the bottom end provides a flat land between adjacent ones of the at least one die formed portion.

6. The metal pallet defined in claim 1, wherein spaced-apart transversal corrugated slats are mounted to said flat lands of said beams to form a base of the metal pallet.

7. The metal pallet defined in claim 1, wherein said at least one die formed portion comprises two longitudinally spaced-apart die formed portions in said one-piece sheet metal body, said two longitudinally spaced-apart formed portion leaving a flat land therebetween at the bottom end of the one-piece sheet metal body.

8. The metal pallet defined in claim 1, wherein the at least one corrugated metal panel comprises a front panel and a rear panel, and wherein the deck further comprises a central corrugated slat disposed between the front and the rear panels, the central corrugated slat having a corrugation profile similar to the first type of corrugations of the front and rear panels.

9. The metal pallet defined in claim 1, wherein the opposed longitudinal edge portions of the at least one corrugated metal panel have a multi-ply construction.

10. The metal pallet defined in claim 6, wherein the corrugated slats forming the base of the pallet have downwardly sloping longitudinal sides extending between longitudinally spaced-apart mounting flanges.

11. The metal pallet defined in claim 10, wherein the downwardly sloping longitudinal sides have a multi-ply construction.

12. The metal pallet defined in claim 1, wherein an anti-skid surface treatment is applied on the top facing surface of the at least one corrugated panel, the anti-skid surface treatment comprising a set of embossments protruding upwardly from top webs of the corrugations.

13. The metal pallet defined in claim 1, wherein the deck comprises at least one transversal corrugated top panel, wherein the pallet has a base mounted to an underside of the plurality of laterally spaced-apart beams, the base including transversal corrugated bottom slats, and wherein the downwardly projecting ridges of the corrugations of the bottom slats are configured to fit in corresponding troughs of the corrugations of the at least one transversal corrugated top panel, thereby allowing similar pallets to be stacked in a nesting engagement.

* * * * *